United States Patent [19]

Rosenberger et al.

[11] Patent Number: 4,717,093

[45] Date of Patent: Jan. 5, 1988

[54] PENGUIN MISSILE FOLDING WING CONFIGURATION

[75] Inventors: Mark A. Rosenberger, East Farmingdale; John J. Ettinger, Bay Shore, both of N.Y.

[73] Assignee: Grumman Aerospace Corporation, Bethpage, N.Y.

[21] Appl. No.: 764,457

[22] Filed: Aug. 12, 1985

[51] Int. Cl.[4] ..... B64C 3/56

[52] U.S. Cl. ..... 244/49; 244/3.28

[58] Field of Search ..... 244/46, 49, 3.27, 3.28, 244/3.29

[56] References Cited

U.S. PATENT DOCUMENTS

| | | | |
|---|---|---|---|
| 2,468,425 | 4/1949 | Carpenter et al. | 244/49 |
| 2,719,682 | 10/1955 | Handel . | |
| 2,876,677 | 10/1959 | Clark et al. . | |
| 2,925,233 | 2/1960 | Dunn et al. . | |
| 2,925,966 | 2/1960 | Kongelbeck . | |
| 2,977,880 | 4/1961 | Kershner . | |
| 3,058,422 | 10/1962 | Olsson . | |
| 3,063,375 | 11/1962 | Hawley et al. . | |
| 3,065,938 | 11/1962 | Calkins . | |
| 3,588,004 | 6/1971 | Suter . | |
| 3,724,373 | 4/1973 | Rivens . | |
| 4,165,847 | 8/1979 | Detalle . | |
| 4,262,862 | 4/1981 | Huffer | 244/3.29 |
| 4,410,151 | 10/1983 | Höppner et al. . | |
| 4,523,728 | 6/1985 | Frazer . | |

FOREIGN PATENT DOCUMENTS

| | | |
|---|---|---|
| 1950638 | 4/1971 | Fed. Rep. of Germany . |
| 2649643 | 6/1978 | Fed. Rep. of Germany . |
| 2153982 | 8/1985 | United Kingdom . |

*Primary Examiner*—Galen Barefoot

*Attorney, Agent, or Firm*—Pollock, VandeSande & Priddy

[57] ABSTRACT

An over-center locking mechanism is provided for a guided missile foldable wing structure which ensures stable reliable and non-reversible locking of the foldable wing. A pyrotechnic actuator is connected to the mechanism and, upon firing, quickly operates the mechanism to a deployed condition.

2 Claims, 7 Drawing Figures

WING EXTENDED
FIG. 6
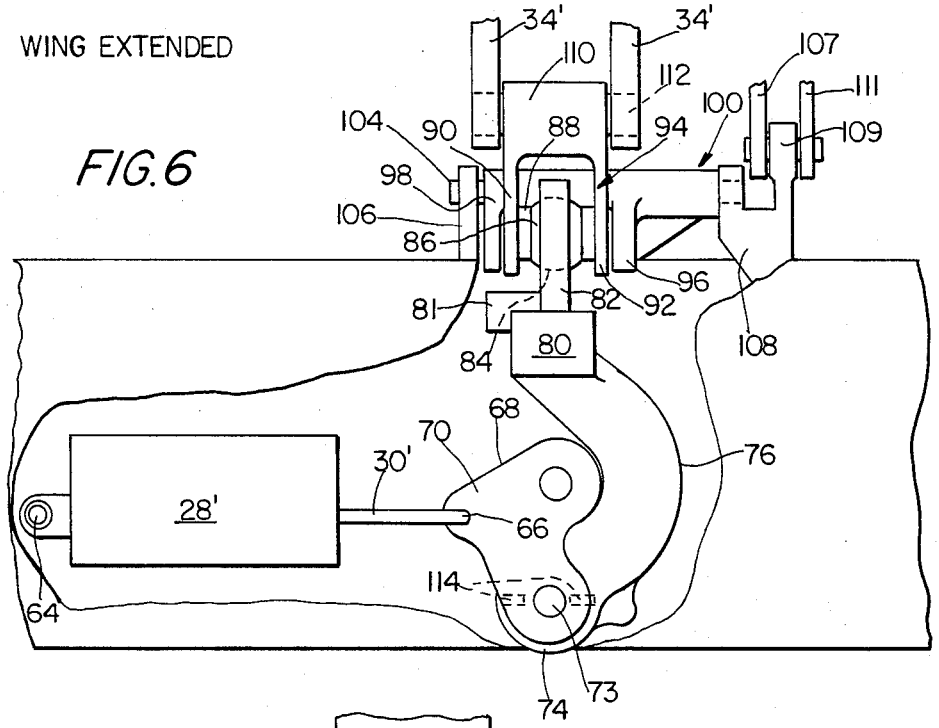
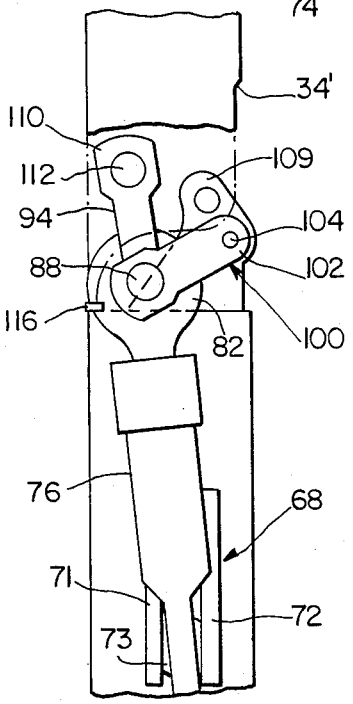
FIG. 7
WING EXTENDED

PENGUIN MISSILE FOLDING WING CONFIGURATION

FIELD OF THE INVENTION

The present invention relates to wing structures for guided missiles, and more particularly to a folding wing configuration.

BACKGROUND OF THE INVENTION

In many present day military applications of guided missiles, the space requirements for a missile, due to wingspan, become an imposing factor. For example, the Penguin missile is a surface-to-surface weapon currently in the possession of a number of national navies. The missile is stored and launched from a canister approximately 43 inches ×43 inches due to the relatively large wingspan of 1.49 meters. As will be appreciated, when storing a number of these missiles in canisters, the pressure of storage space becomes a primary concern. This is particularly the case when missiles of this sort are adapted for use by aircraft such as helicopters. If a relatively large missile with the corresponding necessarily large wingspan is to be employed, it has been recognized that a folding wing configuration must be designed to provide clearance with the ground plane and to provide a reasonable envelope when carried on an aircraft such as a helicopter.

If the folding wing configuration is to be employed, the fold mechanism must be enclosed within the wing contour and the wing deployment mechanism must be relatively lightweight and secure so that the wings will remain in a deployed position when a missile with the folding wing contour encounters air resistance and vibration after deployment.

The prior art discloses foldable wing structures for aircraft and missiles.

U.S. Pat. No. 2,719,682 to Handel discloses a foldable aircraft wing wherein lock pin linkages engage detents when the wing is fully deployed. The basic disadvantage of this reference is the reliance upon precise alignment of the lock pins with the corresponding detents to achieve a secure wing position. Oftentimes this is impossible to achieve after a missile becomes airborne and encounters vibration, turbulence and wind resistance. As a result, a deployed missile would quickly become unstable.

U.S. Pat. No. 2,876,677 to Clark, et al., discloses a missile with a folding wing structure which becomes locked into place upon deployment by a hook mechanism. Such a mechanism is unreliable when considering the wide variety of environmental conditions encountered by the wings during deployment.

U.S. Pat. No. 4,410,151 to Hoppner, et al., discloses a missile having folded wings which are hinged to spring mechanisms which force the wings to extend into a deployed position. Latches are utilized to lock the deployed wings into position. This patent suffers from the same problems as mentioned in connection with the Handel patent.

BRIEF DESCRIPTION OF THE PRESENT INVENTION

The present invention offers an improved foldable wing configuration which employs a non-reversible mechanism dependent upon over-center action.

As a practical matter, each of the improved wings may be fabricated from a pair of aluminum castings with the fold mechanism enclosed within the wing contour.

A pyrotechnic actuator is fired and displaces the over-center mechanism to which the wing structure is attached. The use of such an actuator ensures a rapid certain deployment of the foldable wings to a non-reversible position. The over-center mechanism is in marked contrast to the less reliable and less precise mechanisms as discussed previously in connection with the prior art.

All shear and bending loads are supported by a couple provided by a lock and hinge pin, the loads being transferred directly to body lugs. Drag loads are introduced to the forward support by allowing an outer casting to bear against shoulder bushings in the forward hinge lug. The wings are deployed in pairs by their individual actuators and locked in the deployed position by the over-center mechanism. While in the folded condition, the wings are held in place with a precision locking mechanism such as ball locks, inside the pyrotechnic actuators. The over-center mechanism offers the advantage of locking deployed wings in position with loose tolerances between the mechanism linkages.

By virtue of the present invention, a rapid, reliable and stable foldable wing structure may be realized which avoids the problems of the prior art.

BRIEF DESCRIPTION OF THE FIGURES

The above-mentioned objects and advantages of the present invention will be more clearly understood when considered in conjunction with the accompanying drawings, in which:

FIG. 6 is a cutaway view illustrating the over-center locking mechanism of the present invention as viewed with the foldable wing in a deployed condition.

FIG. 7 is a side cutaway view illustrating the over-center locking mechanism of the present invention as viewed with the foldable wing in a deployed condition.

DETAILED DESCRIPTION OF THE INVENTION

Figure 1:
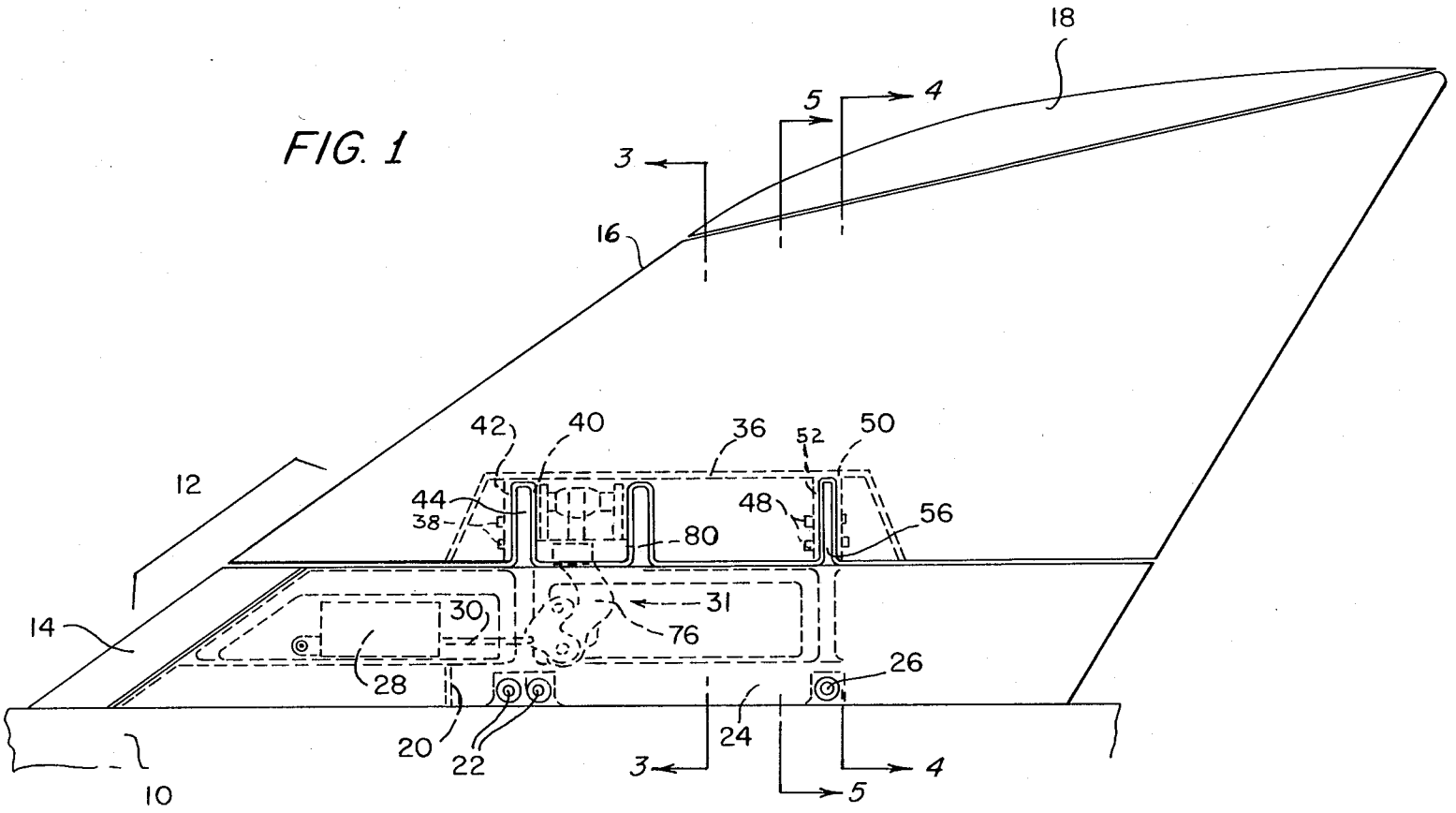
FIG. 1 is an elevational view illustrating a foldable wing section extended co-planar with a fixed wing section.

FIG. 1 is an elevational view illustrating the structure of a foldable wing as constructed in accordance with the present invention.

The wing 12 is attached to a missile fuselage which would be located at reference numeral 10. Wing 12 has an inboard fixed wing section 14 and an outboard foldable wing section 16. A plastic tip cap 18 may be bonded in place along the outer edge of the foldable wing section 16 in order to achieve a desired contour.

Figure 4:
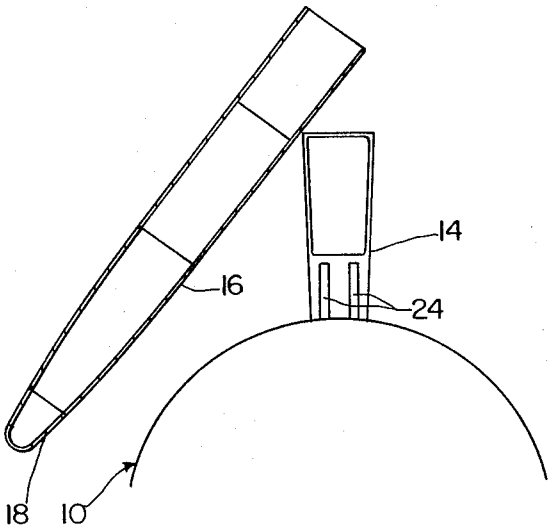
FIG. 4 is a partial cross-sectional view taken along a plane passing through section line 4—4 of FIG. 1.

Reference numeral 20 indicates a single casting which is preferably fabricated from aluminum. Fasteners 22 are employed to secure the fixed wing section 14 to the fuselage 10. Additional attachment between the wing and fuselage is achieved by fastener 26 which connects the fixed wing section 14 with mounting lugs 24 located on fuselage 10 which are received within conforming spaces formed in the fixed wing section 14 as seen in FIG. 4.

A pyrotechnic actuator 28 is located within a recess formed in the fixed wing section 14 and may use a cartridge of the type manufactured by Martin Baker Ltd. of England. Such actuators typically use a firing pin which hits a primer to fire a gas cartridge which then generates a high pressure against an actuator piston. An actuator rod 30 is then displaced to cause operation of an over-center mechanism generally indicated by reference numeral 31 in FIG. 1 and discussed in greater detail hereinafter. The over-center mechanism is connected to the foldable wing section 16

During deployment, loads from foldable wing section 16 are transmitted to the wing section 14 via chassis section 36 and pins 38 connected between clevis flanges 40 and 42 and lug 44. A similar connection between the wing sections 14 and 16 occurs with pins 48 positioned between flanges 50, 52 and lug 56. Once foldable wing section 16 is deployed, the over-center mechanism prevents a reversal of the deployment motion and locks the wing section 16 in the deployed position.

The foldable wing section 16 may be fabricated with an aluminum honeycomb substructure (not shown) and with chassis section being bonded thereto. The wing skins may be chem-milled. In a preferred embodiment of the invention, the core may be a two-piece bonded assembly so that the bond line matches the chem-milled line in the outer skins. The fixed wing section 14 is fabricated with one contoured surface and open cells which are closed with a skin bonded to the casting on the opposite side.

The Over-Center Mechanism

Figure 2:
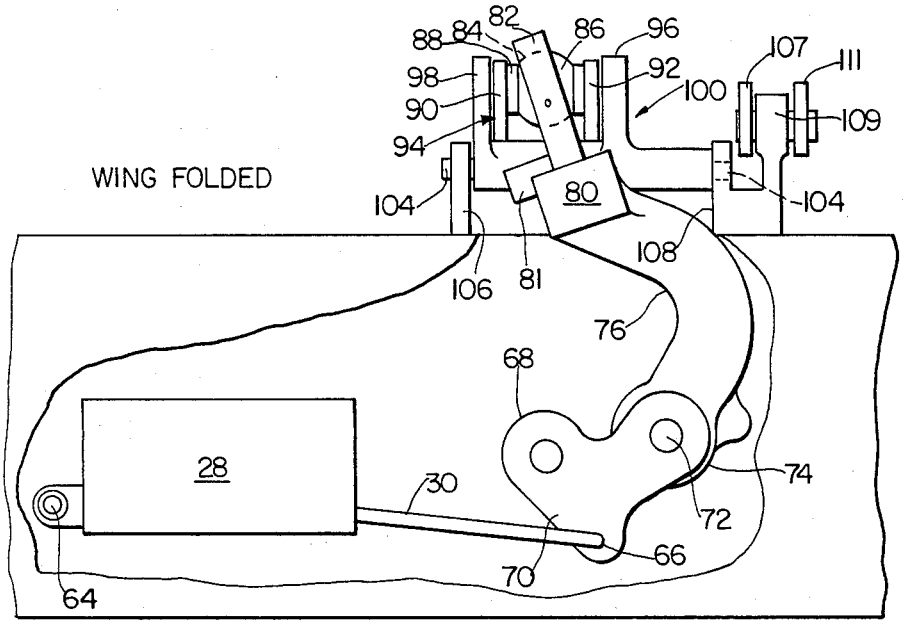
FIG. 2 is a cutaway view illustrating the over-center locking mechanism of the present invention as viewed with the foldable wing in a folded condition.
Figure 3:
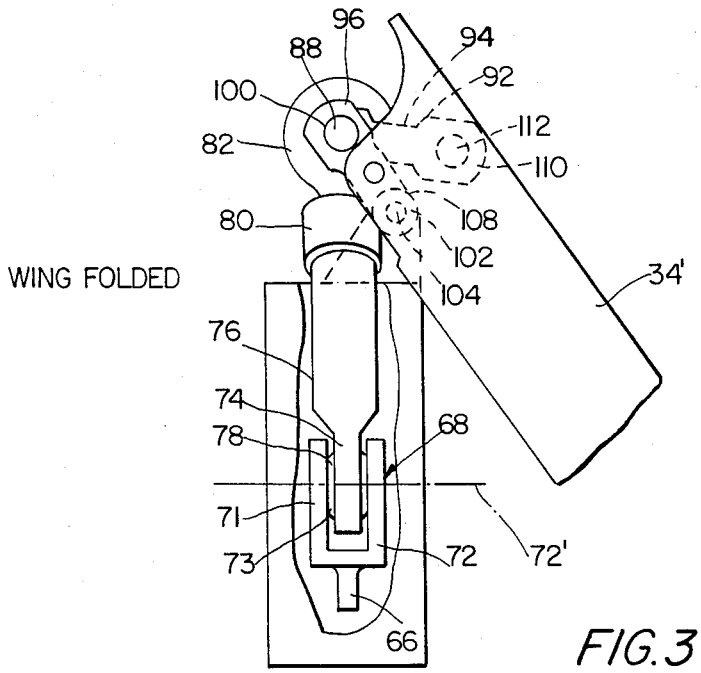
FIG. 3 is a side cutaway view illustrating the over-center locking mechanism of the present invention as viewed with the foldable wing in a folded condition.
Figure 5:
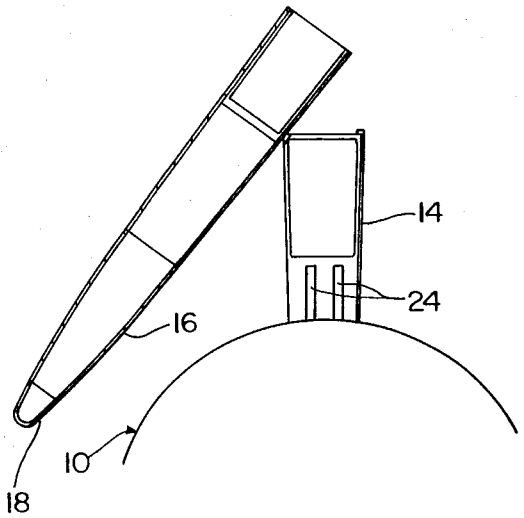
FIG. 5 is a partial cross-sectional view taken along a plane passing through section line 5—5 of FIG. 1.

FIGS. 2, 3, 6 and 7 illustrate a simplified version of the over-center mechanism previously indicated by reference numeral 31 in FIG. 1. More particularly, FIGS. 2 and 3 illustrate the mechanism when the foldable wing section 16 is in a folded or stored condition wherein the wing sections take on the orientation shown in FIGS. 4 and 5. Actuator 28 has its forward fixed end hingedly mounted at 64 and its actuator rod 30 is connected at the outward end thereof to pivot 66 located on flange 70 of the first mechanism linkage 68. Clevis flanges 71 and 72 receive a spherical bearing connector 73 therebetween, the connector likewise engaging the corresponding opening formed in end 74 of a second linkage 76 which is generally U-shaped, as shown in FIG. 2.

An opposite end of linkage 76 takes the form of a generally cylindrically shaped adjustable collar as indicated by reference numeral 80. A closed loop 82 extends upwardly from collar 80 and has an opening 84 formed therein for receiving a spherical bearing connector 86 therein, the spherical bearing connector extending to a shaft portion 88. The connection between closed loop 82 and the bearing connector 86 enables closed loop 82 to swivel between the angular orientation shown in FIG. 2 (folded) and that shown in FIG. 6 (extended). Anti-rotation plate 81 retains adjustable collar loop 82 on the bearing connector 86 and prevents collar 80 from turning after proper adjustment during manufacture. With continued reference to FIGS. 2, 3, 6 and 7, shaft portion 88 passes through apertures formed in the clevis flanges 90 and 92 of linkage 94. The ends of shaft portion 88 are received within the flanges 96 and 98 which characterize a final linkage 100 of the over-center mechanism.

Operation of the over-center mechanism will be understood by comparing FIG. 2 (folded condition) and 6 (extended condition). Operation of actuator 28 causes rod 30 to move inwardly, thereby causing the clockwise rotation of linkage 68. This causes the downward and clockwise rotation of linkage 76 which is transmitted for downward displacement of bearing connector 86. Anti-rotation pawls 114 engage a ratchet interface (not shown) so that rotation of linkages 68 and 76 can only occur in the deployed direction thereby preventing mechanism reversal to the folded condition. Since the bearing connecter is connected to linkage 100, via shaft portion 88, linkage 100 rotates from the position shown in FIG. 3 to the position shown in FIG. 6. The end portion 102 of linkage 100 has a shaft 104 extending outwardly from both ends thereof to engage fixed pivot supports 106 and 108. Linkage 100 acts as a crank having end portion 102 pivotally fixed to the fixed wing section and securing closed loop 82 of linkage 76 thereto. Thus, linkage 100 supports an upper portion of the over-center mechanism to the fixed wing section. The rotation of linkage 100 from the stored to the deployed condition shown in FIGS. 3 and 7 causes a corresponding rotation of linkage 94 which similarly serves as a crank having an outward end 110 pivotally mounted at 112 to the flange 34' of the foldable wing casting. In observing the action of linkage 94 from the stored to the deployed condition as seen in FIGS. 3 and 7, it will be appreciated that as linkage 94 rotates counterclockwise, it pivotally moves the connected flange 34' of the foldable wing section.

Referring to FIGS. 2 and 6, it will be observed that an additional hinge connection is provided between the foldable wing and the fixed wing by means of a pivot support 109 mounted to the fixed wing section, this pivot support mounting chassis flanges 107 and 111 of the foldable wing. When the foldable wing is extended to a deployed position, forces from the foldable wing are transmitted through flanges 107 and 111 to the fixed wing section thereby supporting the foldable wing section in a stable position. As an important design consideration, there must be ample tolerance between the inner connection of linkage members in the over-center mechanism to prevent motion reversal once the mechanism has assumed the deployed condition orientation shown in FIGS. 6 and 7. In FIG. 7 a shim 116 is illustrated as being located between flange 34' and a lower section chassis of the fixed wing section to assist in precise alignment between these members.

As will be appreciated from the foregoing description of the invention, an over-center mechanism for a foldable wing structure is available for achieving rapid deployment of the foldable wings to a reliably locked and stable position which eliminates retraction of the foldable wing section due to forces and vibrations encountered during flight.

It should be understood that the invention is not limited to the exact details of construction shown and described herein for obvious modifications will occur to persons skilled in the art.

We claim:

1. A foldable wing structure comprising:

a fixed wing section adapted for mounting to a fuselage;

a foldable wing section pivotally connected to the fixed wing section and normally assuming a stored condition;

pyrotechnic actuating means located in one of the wing sections;

a non-reversible over-center mechanism connected between the actuating means and the other wing section for rapidly deploying the foldable wing section to an extended position upon firing of the actuating mechanism;

whereby the over-center mechanism includes a plurality of linkages having sufficient dimensional tolerance therebetween for preventing reversible movement of the foldable wing to a stored condition.

2. A foldable wing structure comprising:

a fixed wing section adapted for mounting to a fuselage;

a foldable wing section pivotally connected to the fixed wing section and normally assuming a stored condition;

pyrotechnic actuating means located in one of the wing sections;

an over-center mechanism connected between the actuating means and the other wing section for rapidly deploying the foldable wing section to an extended position upon firing of the actuating mechanism;

the over-center mechanism including:

(a) a first linkage having a point thereon connected to the actuating means;

(b) a second linkage having a first end pivotally connected to the first linkage for displacing the second linkage in response to movement of the first linkage;

(c) a spherical bearing connected to a second end of the second linkage;

(d) a third linkage having a first end also connected to the spherical bearing to permit pivotal rotation of the third linkage upon displacement of the second linkage;

(e) a fourth linkage hingedly mounted at a first end thereof to a stationary pivot, the fourth linkage having a second end pivotally mounted to the spherical bearing thereby causing linked rotation of the linkage ends connected to the bearing; and (f) means pivotally connecting a second end of the third linkage to the foldable wing for pivoting the foldable wing to an extended position in response to firing of the actuating means.

* * * * *